United States Patent [19]

Harrison et al.

[11] Patent Number: 5,073,087

[45] Date of Patent: Dec. 17, 1991

[54] GENERATOR BLOWER ROTOR STRUCTURE

[75] Inventors: Matthew S. Harrison, Orlando; Alan L. Obley, Altamonte Springs, both of Fla.

[73] Assignee: Westinghouse Electric Corp., Pittsburgh, Pa.

[21] Appl. No.: 508,458

[22] Filed: Apr. 13, 1990

[51] Int. Cl.[5] ..... F01D 5/32

[52] U.S. Cl. ..... 416/219 R; 29/889.21

[58] Field of Search ..... 416/204 A, 219 R, 220 R, 416/221; 29/889.21

[56] References Cited

U.S. PATENT DOCUMENTS

| | | | |
|---|---|---|---|
| 2,415,847 | 2/1947 | Redding | 416/219 R |
| 2,619,318 | 11/1952 | Schaer | 416/219 R |
| 2,643,853 | 6/1953 | Redding | 416/221 |
| 3,002,675 | 10/1961 | Howell et al. | 416/219 R |
| 3,532,439 | 10/1970 | Palfreyman et al. | 29/889.21 |
| 3,554,667 | 1/1971 | Wagle | 416/221 |
| 3,692,429 | 9/1972 | Redding | 416/219 R |
| 4,767,274 | 8/1988 | Walter | 416/219 R |

FOREIGN PATENT DOCUMENTS

| | | | |
|---|---|---|---|
| 23802 | 2/1986 | Japan | 416/219 R |

*Primary Examiner*—John T. Kwon

[57] ABSTRACT

A generator rotor part for carrying at least one row of blower blades, each blade having a blade root. The rotor part has the form of a cylinder having a longitudinal axis and composed of at least one first portion having a first outer diameter and at least one second portion axially spaced from, and adjacent to, the first portion, the second portion having a second outer diameter which is less than the first diameter so that the first portion protrudes radially outwardly of the second portion and has a radially extending surface constituting a boundary between the first and second portions. The first portion is provided with a plurality of slots each extending from the radially extending surface and at a given angle of less than 90° relative to the longitudinal axis of the rotor part for receiving and holding the root of a respective blower blade.

12 Claims, 2 Drawing Sheets

GENERATOR BLOWER ROTOR STRUCTURE

BACKGROUND OF THE INVENTION

The present invention relates to electrical generators, and relates particularly to the attachment of blower blades to generator rotors.

Currently, blower blades are connected to their rotors in a variety of ways. According to one approach which is widely used, each blade stage, a stage being composed of a circular array of blower blades, is formed by providing a circumferential slot in a part of the rotor and introducing the root of each blade in succession into the slot.

With this arrangement, replacement of a damaged blade is a time consuming operation since, inter alia, all blades between the damaged blade and the introduction opening associated with the slot must first be removed.

In addition, since, at the blade root, the blade angle is usually inclined to the rotor axis, a mounting arrangement of the type described above requires that the surfaces of the blade root form an angle with the chord line of the blade itself and this complicates the blade manufacturing operation.

SUMMARY OF THE INVENTION

It is an object of the present invention to simplify the manufacture of a generator rotor structure.

Another object of the invention is to facilitate the assembly of blades to a generator rotor part.

Another object of the invention is to facilitate the replacement of a blade in a generator rotor.

The above and other objects are achieved, according to the present invention, by a generator rotor part for carrying at least one row of blower blades, each blade having a blade root, the part having the form of a cylinder having a longitudinal axis and composed of at least one first portion having a first outer diameter and at least one second portion axially spaced from, and adjacent to, the first portion, the second portion having a second outer diameter which is less than the first diameter so that the first portion protrudes radially outwardly of the second portion and has a radially extending surface constituting a boundary between the first and second portions, the first portion being provided with a plurality of slots each extending from the radially extending surface and at a given angle of less than 90° relative to the longitudinal axis of the part for receiving and holding the root of a respective blower blade.

DESCRIPTION OF THE PREFERRED EMBODIMENTS

Figure 1:
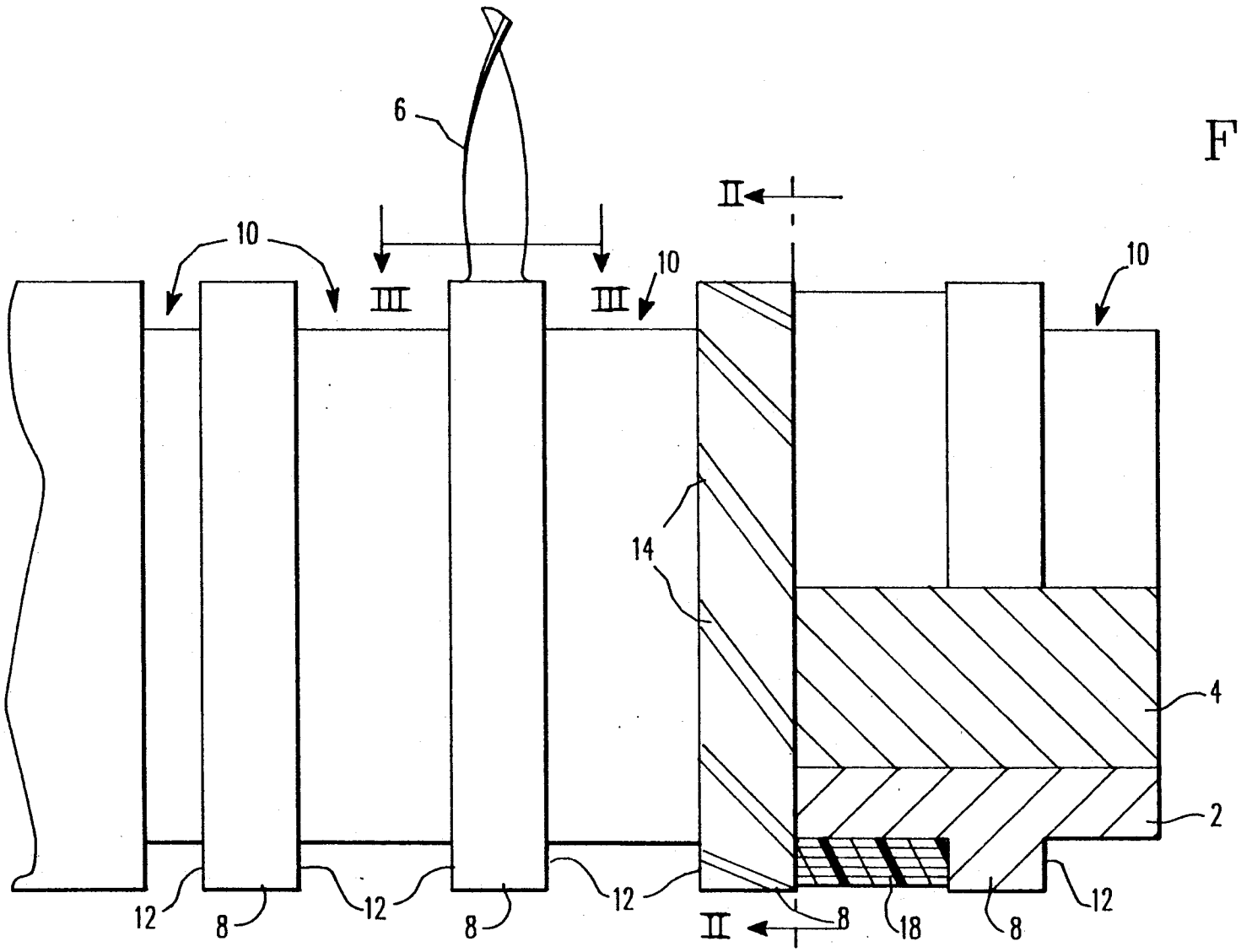
FIG. 1 is a side view, partly in cross section, showing one embodiment of a blower blade support structure according to the invention.
Figure 2:
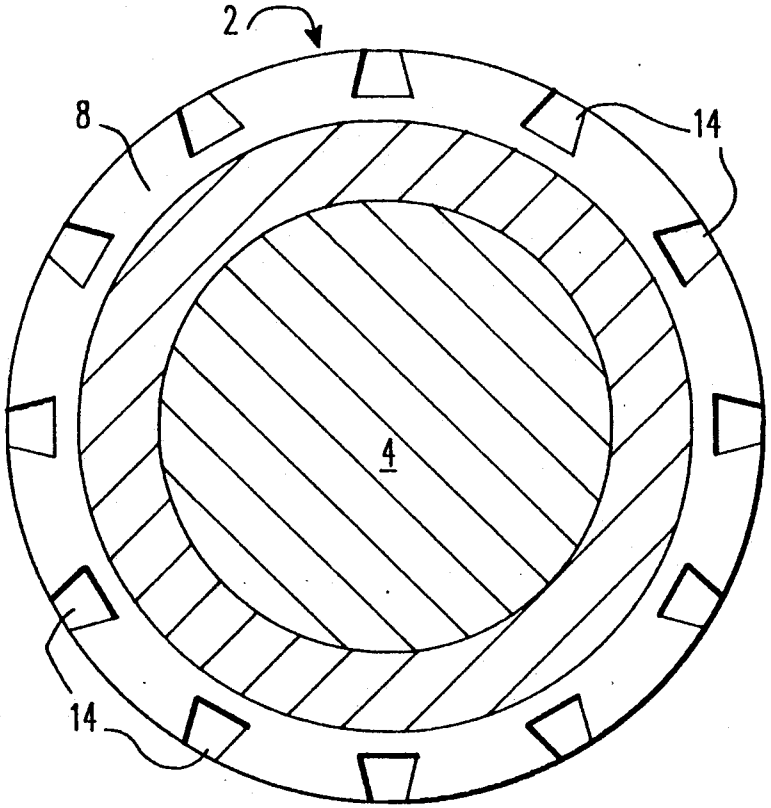
FIG. 2 is a cross-sectional view along line II—II of FIG. 1.

The invention will be described with reference to a blower, which is shown in FIGS. 1 and 2 and is composed of a blower hub 2 mounted on a rotor shaft 4 of a generator. Hub 2 is constructed to carry four blade rows, or stages. One blade 6 of one stage is shown by way of example in FIG. 1.

The blades of each stage are mounted on a respective one of four radially projecting regions 8 created when annular grooves 10 are machined into the outer surface of hub 2.

Each side of projecting region 8 is bounded by a radially extending surface 12 forming a lateral boundary of a respective groove 10.

In accordance with the invention, each projecting region 8 is provided with a plurality of circumferentially spaced blade slots 14. Each slot 14 extends between two axially adjacent grooves 10, i.e., between the surfaces 12 of the associated portion 8, and communicates with the outer cylindrical surface of portion 8.

FIG. 1 shows slots 14 provided in one raised portion 8 and further shows that these slots extend at an acute angle to the axis of rotor 4. As shown in FIG. 2, each slot 14 is shaped to securely retain a blade root, a dovetail shape being illustrated by way of example. The base of each slot 14 is located above, and preferably a small distance above, the surface of the adjacent groove 10.

Because of the orientation of slots 14, each slot will receive a single blower blade which can be directly inserted therein from the region of an adjacent groove 10. Preferably, the radial depth of each slot 14 is slightly larger than the corresponding blade root dimension.

A usable arrangement providing the essential advantages of the invention can include slots 14 extending at any angle of less than 90° to the axis of rotor 4.

Preferably, each slot 14 is oriented to extend parallel to the chord line of the blade at the root end of the blade. This arrangement can simplify manufacture of the blade root since the major surfaces of the blade root would then be parallel to the chord line of the blade at its root end.

Figure 3:
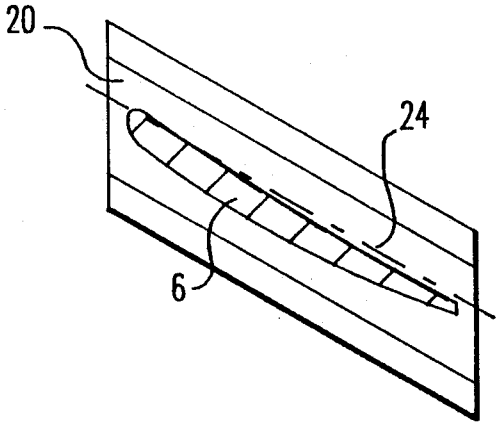
FIG. 3 is a cross-sectional view along line III—III of FIG. 1.

FIG. 3 shows the form which the blade root can have when slots 14 have the orientation described above. Specifically, the longitudinal edges of blade root 20 can be made parallel to blade chord line 24 at the root end of blade 6.

In addition, it is preferable that slots 14 be dimensioned so that the length of each slot 14 is only slightly greater than the corresponding dimension of each blade root 20. This will assure a secure support for each blade while minimizing the machining work required to form slots 14. The angle of each slot 14 relative to the axis of rotor 4 may be selected to assure that each groove 10 has a length parallel to the axis of rotor 4 sufficient to accommodate each blade root 20 prior to insertion into its associated slot 14.

After all slots 14 have received blades 6, the blades are retained in their slots by filling each groove 10 with retaining material 18, as shown for one groove in FIG. 1. Preferably, material 18 is constituted by a flexible strip or band which is wrapped in a plurality of layers around the base of the respective groove 10. Most preferably, the band or strip is made of a woven glass fiber fabric, which is preferred because of its low weight and durability.

After the band or strip constituting material 18 has been wrapped around the associated groove 10, it may be secured in place by a suitable adhesive. If it should subsequently be necessary to replace a blade 6, this only requires unwrapping of one band or strip, after which the affected blade 6 may be slipped out of its associated slot 14, followed by insertion of a new blade, and wrapping of a new band or strip of flexible material 18 around the base of groove 10.

The invention is particularly applicable for use in generator structures in which the rotor assembly, including the blades, has a diameter smaller than the stator core bore diameter so that the rotor and blades can be installed in, and removed from, the stator as a unit. This also allows the blades to be mounted as a permanent part of the rotor assembly prior to installation in the stator bore.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A turbine rotor assembly comprising: a rotor part for carrying at least one row of blower blades, said rotor part having the form of a cylinder having a longitudinal axis and composed of two first portions spaced apart along the longitudinal axis and each having a first outer diameter and at least one second portion extending axially between said first portions, said second portion having a second outer diameter which is less than said first diameter so that said first portions protrude radially outwardly of said second portion and each first portion has a radially extending surface constituting a boundary with said second portions, each said first portion being provided with a plurality of slots each extending from said radially extending surface and at a given angle of less than 90° relative to the longitudinal axis of said rotor part for receiving and holding the root of a respective blower blade; a plurality of blower blades, each blade having a blade root secured in a respective one of said slots in each said first portion; and blade retaining means located at said second portion and blocking said slots at each said radially extending surface, wherein said blade retaining means consist of a flexible band wrapped a plurality of time around said second portion of said rotor part and having a width selected to fill the space along the longitudinal axis between said first portions.

2. An assembly as defined in claim 1 wherein each of said slots has a base which is spaced radially outwardly of said second portion.

3. An assembly as defined in claim 2 wherein each said slot has a cross section such that the width of said slot decreases in the radial outward direction.

4. An assembly as defined in claim 3 wherein each said slot has a dovetail cross section.

5. An assembly as defined in claim 4 composed of two said second portions, with one said first portion being disposed between said second portions and having two said radially extending surfaces each constituting a boundary between said one first portion and a respective one of said second portions, and wherein each said slot extends between said two radially extending surfaces.

6. A generator rotor part as defined in claim 1 composed of two said second portions, with said portion being disposed between said second portions and having two said radially extending surfaces each constituting a boundary between said first portion and a respective one of said second portions, and wherein each said slot extends between said two radially extending surfaces.

7. An assembly as defined in claim 1 wherein said band is constituted by a strip of tape.

8. An assembly as defined in claim 7 wherein said tape is made of a glass material.

9. An assembly as defined in claim 8 wherein the tape is made of a woven glass fiber.

10. An assembly as defined in claim 1 wherein each blade has a chord line and each slot extends parallel to the chord line of its respective blade at the end adjacent said blade root and at an acute angle to the longitudinal axis of said rotor part.

11. A method producing the rotor assembly defined in claim 1 comprising: inserting the blade root of a respective blower blade in each said slot; and wrapping said band around said second portion in order to block each said slot at each said radially extending surface.

12. An assembly as defined in claim 1 wherein said second portion has an outer peripheral surface which forms a groove with said radially extending surfaces and said flexible band fills said groove.

* * * * *